US008030857B2

(12) United States Patent
Kita

(10) Patent No.: US 8,030,857 B2
(45) Date of Patent: Oct. 4, 2011

(54) BACKLIGHT LED DRIVE CIRCUIT

(75) Inventor: Tatsuya Kita, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 463 days.

(21) Appl. No.: 12/288,499

(22) Filed: Oct. 21, 2008

(65) Prior Publication Data

US 2009/0102399 A1 Apr. 23, 2009

(30) Foreign Application Priority Data

Oct. 22, 2007 (JP) ..... 2007-274227

(51) Int. Cl.
*H05B 41/36* (2006.01)

(52) U.S. Cl. ..... 315/307; 315/308; 315/224; 315/291; 345/102

(58) Field of Classification Search ..... 315/307, 315/308, 224, 247, 291, 119, 185 S; 345/82, 345/102, 204
See application file for complete search history.

(56) References Cited

U.S. PATENT DOCUMENTS 6,909,249 B2 * 6/2005 Otake ..... 315/291
7,531,971 B2 * 5/2009 Weng ..... 315/291

FOREIGN PATENT DOCUMENTS

JP H03-255684 A 11/1991
JP 2007-013183 A 1/2007
JP 2007-096296 A 4/2007

* cited by examiner

*Primary Examiner* — Daniel D Chang
(74) *Attorney, Agent, or Firm* — Yokoi & Co., U.S.A., Inc.; Toshiyuki Yokoi

(57) ABSTRACT

A backlight LED drive circuit 20 includes a step-up DC/DC converter 22 for stepping up a DC power voltage based on a PWM signal and supplying the voltage to the anode of an LED device 12*c*, a voltage detector 24 for detecting a feedback voltage FBV based on a voltage at a terminal 22*b* coupled to the cathode of the LED device, a PWM control circuit 26 for outputting a PWM signal to the step-up DC/DC converter 22 so that the feedback voltage FBV may become a predetermined voltage, and a PWM stop circuit 28 for stopping the PWM signal when the feedback voltage FBV is below a second predetermined voltage set smaller than the predetermined voltage. Thereby, such backlight LED drive circuit causes no troubles even when terminal to which the LED device is connected is rendered open.

7 Claims, 5 Drawing Sheets

RELATED ART

BACKLIGHT LED DRIVE CIRCUIT

CROSS REFERENCE TO RELATED APPLICATIONS

The present application is related to the Japan Patent Application No. 2007-274227, filed Oct. 22, 2007, the entire disclosure of which is expressly incorporated by reference herein.

BACKGROUND OF THE INVENTION

1. Field of the Invention

The present invention relates to a backlight LED drive circuit for driving LED (Light Emitting Diode) used for a backlight of a liquid crystal panel.

2. Description of the Related Art

A backlight LED drive circuit for driving LED used for a backlight of a liquid crystal panel is well known. FIG. 5 is a block diagram showing a conventional backlight LED drive circuit. Referring to FIG. 5, a backlight LED drive circuit 1 includes a step-up DC/DC converter 2, voltage detector 3, and PWM control circuit 4. The drive circuit 1 steps up a DC supply voltage based on a PWM signal output from the PWM control circuit 4 and supplies the stepped up voltage to an LED device 5 formed of a plurality of LEDs connected in series. At this time, a feedback voltage (FB voltage) based on the voltage on the cathode side of the LED device 5 is detected and the PWM signal is controlled so that the feedback voltage may become a predetermined voltage. For example, when the feedback voltage becomes higher than the predetermined voltage, the duty ratio of the PWM signal is decreased so that the stepped up voltage is lowered, and when the feedback voltage becomes lower than the predetermined voltage, the duty ratio of the PWM signal is increased so that the stepped up voltage is raised.

There are proposed various drive circuits for driving an LED device suitably. For example, there is disclosed, in JP-A 2007-96296 (hereinafter called Patent Document 1), a display apparatus capable of preventing continuous increase in its standby power when a light source is turned off, thereby improving its display characteristic. In JP-A 2007-13183 (hereinafter called Patent Document 2), there is disclosed a backlight LED drive circuit having a PWM control unit for ON/OFF controlling a switch with a switching pulse having a duty ratio determined in accordance with a predetermined internal reference voltage and a detected voltage detected by a voltage detecting resistor. Further, in JP-A H03-255684 (hereinafter called Patent Document 3), there is disclosed a drive circuit of a light emitting device having its oscillator circuit provided with a switch as a control means for controlling oscillation to be made and stopped, and thereby deterioration or breakage of the light emitting device is prevented and the current flowing through the light emitting device is switched at a high speed.

Now, in the backlight LED drive circuit 1 shown in FIG. 5, if for example the LED device 5 becomes unconnected with the connection terminals 2*a*, 2*b* or the LED device 5 becomes broken so as to render the connection terminals 2*a*, 2*b* open, then a voltage will not be applied to the connection terminal 2*b*. Hence the feedback voltage will become lower than the predetermined voltage to increase the duty ratio of the PWM signal, and thereby the stepped up voltage output from the connection terminal 2*a* may be increased. At this time, even if the stepped up voltage rises, the feedback voltage remains lower than the predetermined voltage. Therefore, there arises a possibility for example that the duty ratio of the PWM signal is kept at its maximum value and the stepped up voltage at the connection terminal 2*a* continues to rise until it reaches the maximum voltage that the step-up DC/DC converter 2 can output.

The circuit elements constituting a step-up DC/DC converter 2, in general, are designed to have some margin to sustain normal operations. However, in view of the balance between the margin and such a factor as an increase in cost and installation space, it is considered desirable not to use such circuit elements that can stand the above mentioned maximum voltage. Hence, when the connection terminals 2*a*, 2*b* have been rendered open during the operation of the backlight LED drive circuit 1, there has been a possibility of troubles occurring in the circuit elements making up the step-up DC/DC converter 2.

Further, when the LED device 5 has been connected between the connection terminals 2*a*, 2*b* under the condition where the stepped up voltage at the connection terminal 2*a* is high, there has been a possibility of troubles occurring in the LED device 5.

While the arts disclosed in the above mentioned patent documents are not such that prevent occurrence of those troubles, there has not yet been proposed any art to prevent occurrence of troubles when the connection terminals 2*a*, 2*b* are rendered open.

BRIEF SUMMARY OF THE INVENTION

The present invention provides a backlight LED drive circuit causing no troubles in the LED device and the circuit for supplying a voltage to the LED device even when the terminals with which the LED device is connected are rendered open while it is in operation.

A backlight LED drive circuit for driving an LED device as a backlight of a liquid crystal display panel, the present invention is configured of a step-up DC/DC converter for stepping up a DC power voltage in accordance with a PWM signal and supplying the stepped up voltage to the anode side of the LED device, a voltage detector for detecting a feedback voltage based on a voltage at the terminal coupled to the cathode side of the LED device, a PWM control circuit for outputting the PWM signal to the step-up DC/DC converter so that the feedback voltage may become equal to a predetermined voltage, and a PWM stop circuit to stop the outputting of the PWM signal to the step-up DC/DC converter when the feedback voltage is lower than a second predetermined voltage which is set lower than the above mentioned predetermined voltage.

In the backlight LED drive circuit configured as described above, when the feedback voltage is lower than the second predetermined voltage set lower than the predetermined voltage, the outputting of the PWM signal to the step-up DC/DC converter is stopped, and therefore the DC power voltage, as the raw voltage to be stepped up by the step-up DC/DC converter during its operation, is prevented from being stepped up.

According to the present invention as described above, the DC power voltage, as the raw voltage to be stepped up by the step-up DC/DC converter during its operation, is not stepped up, and therefore an overvoltage is prevented from being applied to each part of the step-up DC/DC converter or the terminal with which the anode side of the LED device is connected. Thus, a backlight LED drive circuit, causing no troubles in the LED device and the step-up DC/DC converter for supplying a power voltage to the LED device, can be provided.

Preferably, such a configuration may also be made in which the second predetermined voltage is an open/closed determining voltage for determining that no voltage is applied to the above referred terminal while the step-up DC/DC converter is in operation.

By making such a configuration, the outputting of the PWM signal to the step-up DC/DC converter can be suitably stopped when no voltage is applied to the terminal while the step-up DC/DC converter is in operation.

According to the present invention, since the outputting of the PWM signal to the step-up DC/DC converter can be suitably stopped when no voltage is applied to the terminal while the step-up DC/DC converter is in operation, an overvoltage can be suitably prevented from being applied to each part of the step-up DC/DC converter or the terminal with which the anode side of the LED device is connected.

Further, the PWM stop circuit may preferably be configured to stop the outputting of the above described PWM signal to the step-up DC/DC converter also when the above described feedback voltage exceeds a third predetermined voltage set higher than the predetermined voltage. By having such a configuration, an overvoltage can be prevented, when the stepped up voltage cannot be lowered by PWM control, from being applied to each part of the step-up DC/DC converter or the terminal with which the anode side of the LED device is connected.

According to this invention, an overvoltage is prevented from being applied to each part of the step-up DC/DC converter or the terminal with which the anode side of the LED device is connected, and therefore troubles can be prevented from occurring in the LED device and the step-up DC/DC converter for supplying a power voltage to the LED device.

Further, the above mentioned third predetermined voltage may preferably be set to be a high-voltage determining voltage for determining that the above mentioned DC power voltage, as the raw voltage to be stepped up by the step-up DC/DC converter during its operation, is higher than a predetermined voltage. By having this configuration made, when the raw voltage to be stepped up by the step-up DC/DC converter during its operation is higher than the predetermined voltage, the outputting of the PWM signal to the step-up DC/DC converter can be suitably stopped.

According to this invention, since the outputting of the PWM signal to the step-up DC/DC converter can be suitably stopped when the above mentioned DC power voltage, as the raw voltage to be stepped up by the step-up DC/DC converter during its operation, is higher than the predetermined voltage, and therefore an overvoltage is suitably prevented from being applied to each part of the step-up DC/DC converter or the terminal with which the anode side of the LED device is connected.

Further, such a configuration may preferably be made in which the PWM control circuit and the PWM stop circuit are incorporated in a panel drive circuit for driving the liquid crystal panel.

Further, the panel drive circuit may preferably be configured as a liquid crystal driver IC mounted on a glass substrate forming the liquid crystal panel.

According to this invention, since the PWM control circuit and the PWM stop circuit are incorporated in the panel drive circuit for driving the liquid crystal panel, cost down and space-efficiency improvement can be attained. Further, since the panel drive circuit is configured of a liquid crystal driver IC mounted on a glass substrate constituting the liquid crystal panel, further cost down and improvement in the space efficiency can be attained.

Further, preferably, the step-up DC/DC converter may be configured of a chopper type DC/DC converter having a choke coil connected to the DC power voltage of 3.3V, a switching element connected to the choke coil for performing a switching operation based on the PWM signal, and a smoothing capacitor connected to the output side, and the PWM control circuit and the PWM stop circuit may be incorporated in a liquid crystal driver IC mounted on a glass substrate configuring the above liquid crystal panel to output the PWM signal to the chopper type DC/DC converter so that the feedback voltage may become the predetermined voltage set at 0.6V, and to stop the outputting of the PWM signal to the step-up DC/DC converter when the feedback voltage is below the second predetermined voltage set at 0.2V to determine that no voltage is applied to the terminal while the chopper type DC/DC converter is in operation, or when the feedback voltage is above a third predetermined voltage set at 1.1V to determine that the DC power voltage, as the raw voltage to be stepped up by the chopper type DC/DC converter during its operation, is higher than the specified 3.3V. By having the configuration made as described above, the outputting of the PWM signal to the step-up DC/DC converter is suitably stopped when no voltage is applied to the terminal while the step-up DC/DC converter is in operation. Further, also when the stepped up voltage cannot be lowered by PWM control because the DC power voltage, as the raw voltage to be stepped up by the step-up DC/DC converter during its operation, is higher than the specified voltage, the outputting of the PWM signal to the step-up DC/DC converter can be suitably stopped, so that an overvoltage can be prevented from being applied to each part of the step-up DC/DC converter or the terminal with which the anode side of the LED device is connected.

According to this invention, since the outputting of the PWM signal to the step-up DC/DC converter is suitably stopped when no voltage is applied to the terminal while the step-up DC/DC converter is in operation, the outputting of the PWM signal to the step-up DC/DC converter is suitably stopped, an overvoltage is suitably prevented from being applied to each part of the step-up DC/DC converter or the terminal with which the anode side of the LED device is connected. Further, also when the stepped up voltage cannot be lowered by PWM control because the DC power voltage, as the raw voltage to be stepped up by the step-up DC/DC converter during its operation, is higher than a predetermined voltage, the outputting of the PWM signal to the step-up DC/DC converter can be suitably stopped, and therefore an overvoltage is prevented from being applied to each part of the step-up DC/DC converter or the terminal with which the anode side of the LED device is connected. Accordingly, no troubles are caused in the LED device and the step-up DC/DC converter for supplying a voltage to the LED device. Further, since the PWM control circuit and the PWM stop circuit can be incorporated in liquid crystal driver IC mounted on the glass substrate constituting the liquid crystal panel, further cost down and improvement in the space efficiency can be attained.

DETAILED DESCRIPTION OF THE INVENTION

Below will be described an embodiment of the present invention according to the following items:

(1) Schematic configuration of a liquid crystal monitor apparatus;

(2) Configuration of a backlight LED drive circuit;

(3) Variations; and (4) Conclusion.

(1) Schematic Configuration of a Liquid Crystal Monitor Apparatus

Figure 1:
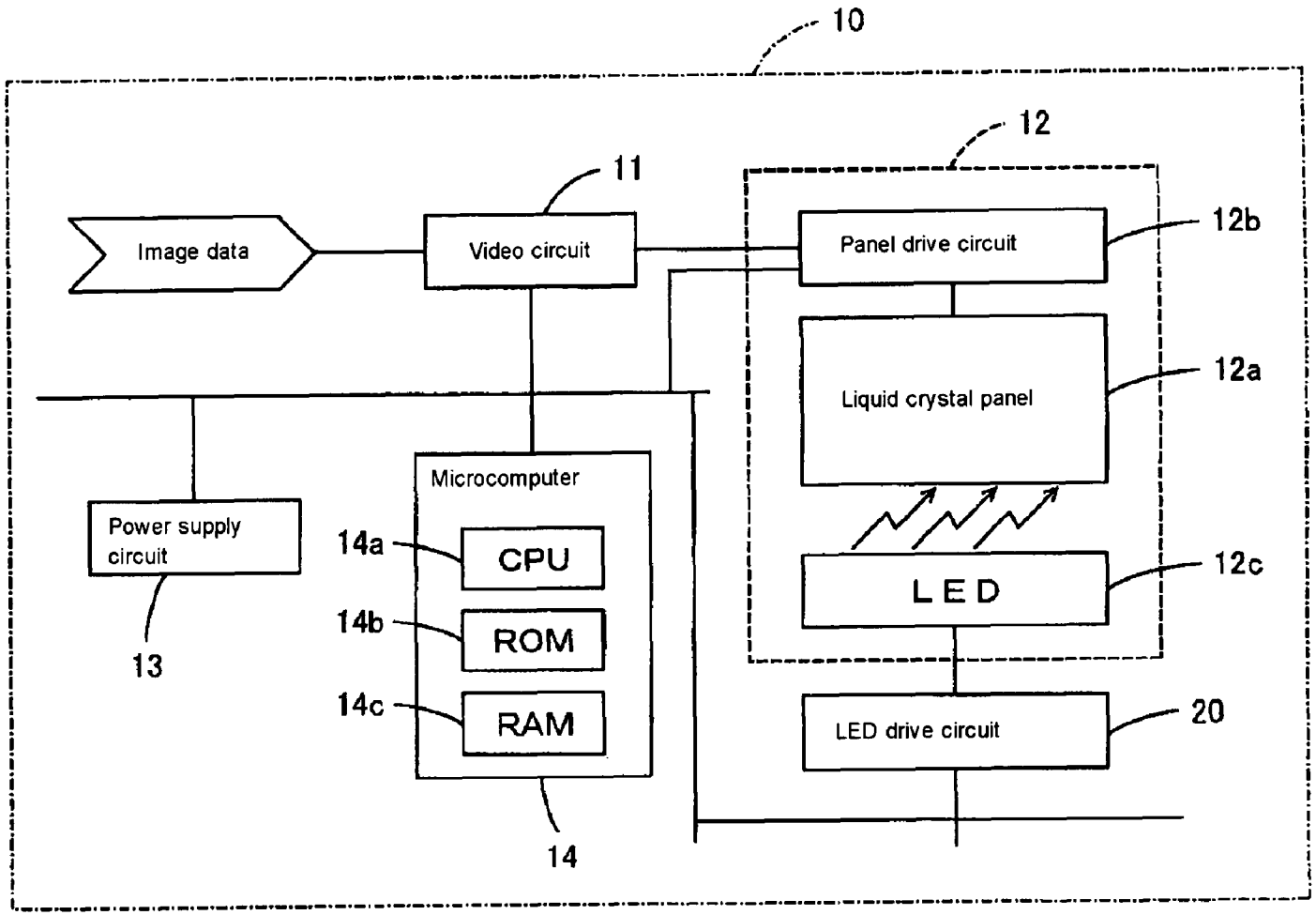
FIG. 1 is a block diagram showing a schematic configuration of a liquid crystal monitor apparatus including a backlight LED drive circuit to which the present invention is applied.

Referring to FIG. 1, a schematic configuration of the liquid crystal monitor apparatus 10 including a backlight LED drive circuit 20 (herein after called "LED drive circuit 20", refer to FIG. 2) to which the present invention is applied will be described. FIG. 1 is a block diagram of the liquid crystal monitor apparatus 10. In FIG. 1, the liquid crystal monitor apparatus 10 includes a video circuit 11, liquid crystal module 12, power supply circuit 13, microcomputer 14, and the LED drive circuit 20.

The power supply circuit 13 receives a supply of a power voltage (AC) from an external commercial power source or the like on one hand, and on the other hand, supplies the received power voltage to the microcomputer 14 and other circuits such as the LED drive circuit 20. The power supply circuit 13 converts, as needed, the voltage to be supplied to each circuit from AC to DC.

The microcomputer 14 is electrically connected with each part constituting the liquid crystal monitor apparatus 10; a CPU 14*a*. as an internal component part of the microcomputer 14, controls the entirety of the liquid crystal monitor apparatus 10 in accordance with programs written in a ROM 14*b* and RAM 14*c*, which are also internal component parts of the microcomputer 14.

The video circuit 11 performs, on received digital image data consisting of RGB (red, green, and blue) signals, a scaling process adapted to number of pixels arranged in a matrix array on a liquid crystal panel 12*a* (horizontal to vertical ratio m:n) to thereby generate image data for one screen to be displayed on the liquid crystal panel 12*a*. Further, the same, after performing various processes such as brightness compensation, contrast adjustment, and saturation compensation on the image data, outputs the processed image data to the liquid crystal module 12. Incidentally, the digital image data formed of the RGB signals may be image data generated by matrix conversion processing based on the luminance signal and color-difference signal extracted from the video signal as the basis to express a given picture image or such image data as generated by a microcomputer or the like. Further, the above referred video signal is for example such a video signal extracted by a known tuner circuit from a television broadcast signal received through a known antenna or a video signal output from a video reproducing apparatus.

The liquid crystal module 12 is made up of the liquid crystal panel 12*a*, panel drive circuit 12*b*, and LED device 12*c*. The liquid crystal panel 12*a* is for example a panel of an active matrix drive system. The panel drive circuit 12*b* is controlled on the basis of image data output from the video circuit 11 to drive the liquid crystal panel 12*a* and thereby allows an image corresponding to the image data to be displayed on the liquid crystal panel 12*a*. The LED device 12*c* constitutes a light source for illuminating the liquid crystal panel 12*a* from its back side, namely a backlight of the liquid crystal panel 12*a*, and has for example a plurality of LEDs.

The LED drive circuit 20 drives the LED device 12*c* used for the backlight of the liquid crystal panel 12*a*.

(2) Configuration of a Backlight Led Drive Circuit

Figure 2:
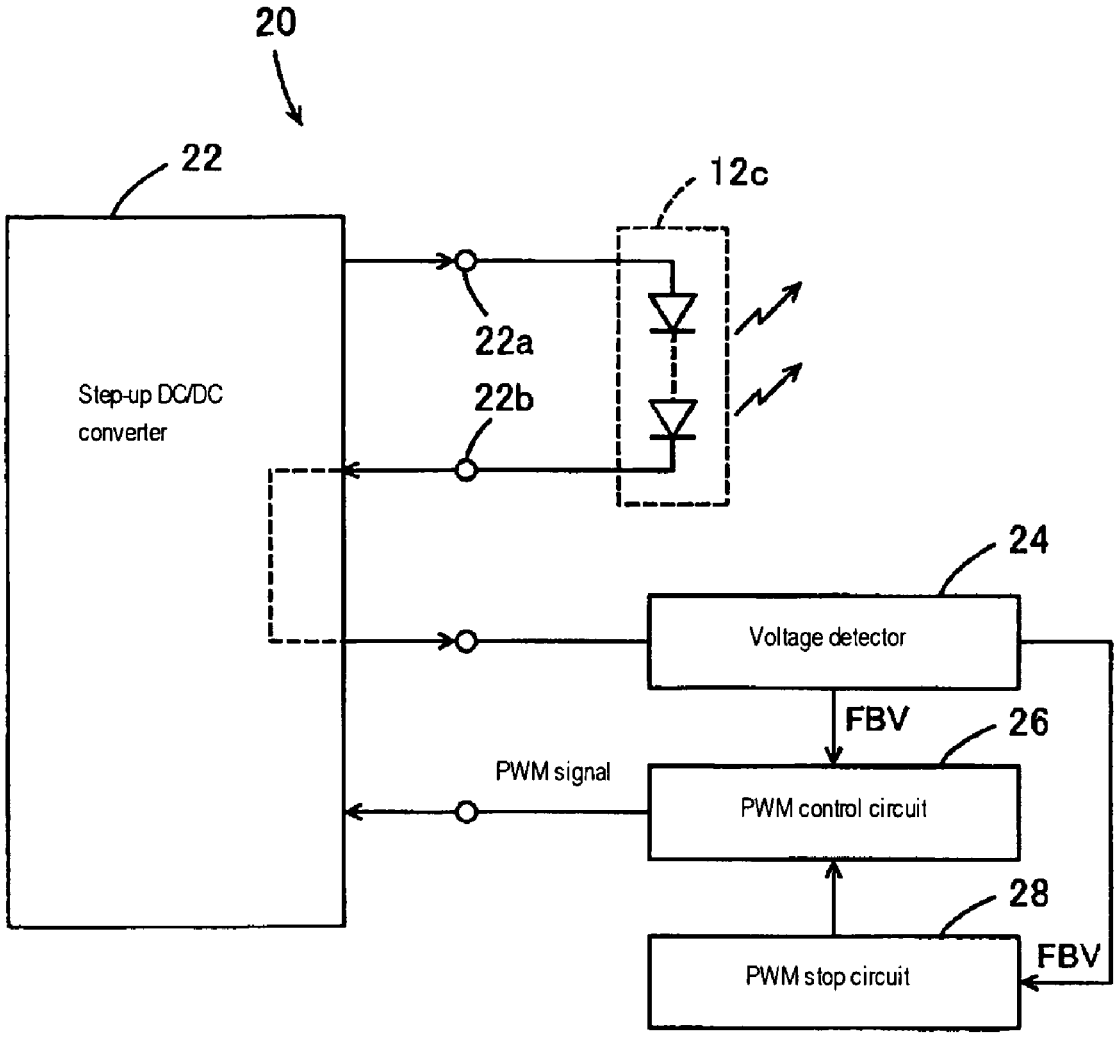
FIG. 2 is a block diagram exemplifying a configuration of an LED drive circuit.

FIG. 2 is a block diagram of the LED drive circuit 20. In FIG. 2, the LED drive circuit 20 includes a step-up DC/DC converter 22, voltage detector 24, PWM control circuit 26, and PWM stop circuit 28.

The step-up DC/DC converter 22, based on a PWM signal, steps up a DC power voltage supplied from the power supply circuit 13 and supplies the stepped up voltage to the terminal 22*a* coupled to the anode side of the LED device 12*c* to illuminate the LED device 12*c*.

The voltage detector 24 detects a feedback voltage FBV based on a cathode-side voltage at the terminal 22*b* oupled to the cathode side of the LED device 12*c*.

The PWM control circuit 26 outputs a PWM signal to the step-up DC/DC converter 22 so that the feedback voltage FBV may become a predetermined voltage.

The PWM stop circuit 28, when the feedback voltage FBV is below the second predetermined voltage set lower than the predetermined voltage, causes the outputting of the PWM signal to the step-up DC/DC converter 22 to be stopped. Also when the feedback voltage FBV is above the third predetermined voltage set higher than the predetermined voltage, the PWM stop circuit 28 causes the outputting of the PWM signal to the step-up DC/DC converter 22 to be stopped.

The above mentioned predetermined voltage may for example be a previously established proper voltage of the feedback voltage FBV to provide a proper stepped up voltage that will appropriately illuminate the LED device 12*c*.

The second predetermined voltage may for example be a previously established open/closed determining voltage for determining that no cathode-side voltage is applied to the terminal 22*b* while the step-up DC/DC converter 22 is in operation.

The third predetermined voltage may for example be a previously established a high-voltage determining voltage for determining that the DC power voltage supplied from the power supply circuit 13, as the raw voltage to be stepped up by the step-up DC/DC converter 22 during its operation, is higher than a specified voltage.

By having the LED drive circuit 20 configured as described above, when no voltage is applied to the terminal 22*b* coupled to the cathode side of the LED device 12*c* and the feedback voltage FBV is below the second predetermined voltage while the step-up DC/DC converter 22 is in operation, the outputting of the PWM signal to the step-up DC/DC converter 22 is stopped. Therefore, the DC power voltage, as the raw voltage to be stepped up by the step-up DC/DC converter 22 during its operation, will not be stepped up.

Also, when the stepped up voltage is unable to be lowered by PWM control because the DC power voltage, as the raw voltage to be stepped up by the step-up DC/DC converter 22 during its operation, is higher than the predetermined voltage, the outputting of the PWM signal to the step-up DC/DC converter 22 is suitably stopped. Therefore, an overvoltage is prevented from being applied to each part of the step-up DC/DC converter 22 or the terminal 22*a* with which the anode side of the LED device 12*c* is connected.

Figure 3:
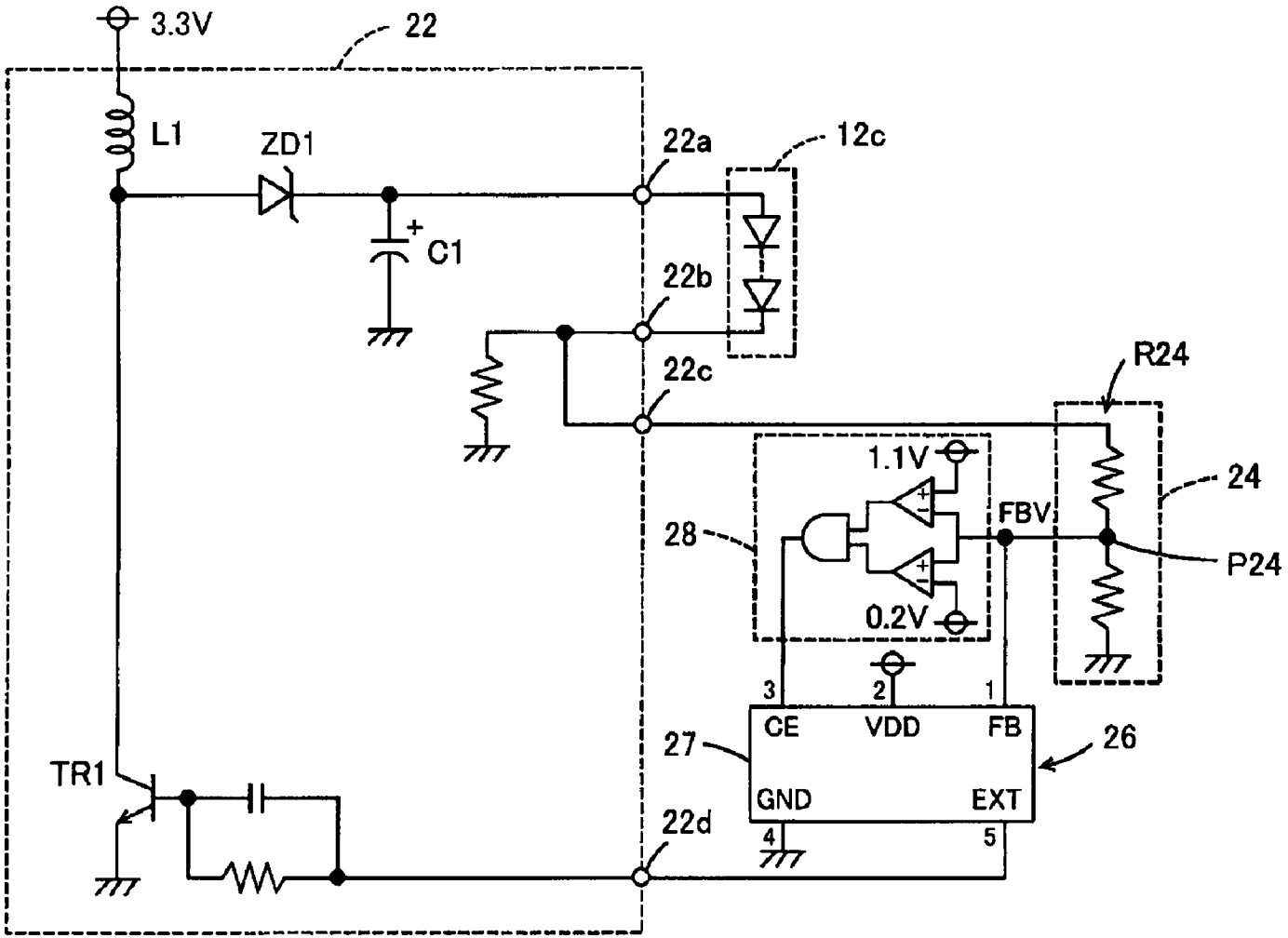
FIG. 3 is a diagram exemplifying a concrete circuit configuration of an LED drive circuit.

FIG. 3 is a diagram showing a concrete example of a circuit configuration of an LED drive circuit 20.

Referring to FIG. 3, the step-up DC/DC converter 22 is a chopper type DC/DC converter having a choke coil L1 connected for example to a DC power voltage of 3.3V, a transistor TR1 connected to the choke coil L1 and serving as a switching element to be switched by a PWM signal input from the terminal 22*d*, and a smoothing capacitor C1 connected with the choke coil L1 through a zener diode ZD1 for smoothing a predetermined voltage pulse generated on the output side of the choke coil L1 by switching operation of the transistor TR1 and connected to the terminal 22*a* on the output side. In the step-up DC/DC converter 22 configured as described above, a voltage stepped up from 3.3V, controlled to be lowered when the duty ratio of the PWM signal is decreased, or to be raised when the duty ratio of the PWM signal is increased, is output from the terminal 22*a* and supplied to the LED device 12*c*.

The voltage detector 24 is provided for example with a voltage dividing resistor R24, of which one end is connected with the terminal 22*c*, in connection with the terminal 22*b* to which the cathode-side voltage is input, and the other end is connected to ground GND. Resistance values of the voltage dividing resistor 24 are set, for example, such that the feedback voltage FBV at the voltage dividing point P24 may become 0.6V when a proper stepped up voltage is supplied to the LED device 12*c*. Hence, the above mentioned predetermined voltage is set at 0.6V.

The PWM control circuit 26 is for example configured of a step-up DC/DC controller IC 27. This step-up DC/DC controller IC 27 functions, for example, to output a PWM signal from Pin No. 5 to the terminal 22*d* in order that the feedback voltage FBV input to Pin No. 1 (FB) becomes the predetermined voltage. 0.6V. For example, when the feedback voltage FBV becomes higher than the predetermined voltage, 0.6V, the duty ratio of the PWM signal is decreased and when conversely the feedback voltage FBV becomes lower than the predetermined voltage, 0.6V, the duty ratio of the PWM signal is increased. Further, the step-up DC/DC controller IC 27 outputs a PWM signal from Pin No. 5 while a high signal is input to Pin No. 3 (CE), but when, on the other hand, a low signal is input to Pin No. 3 (CE), it stops the outputting of the PWM signal from Pin No. 5.

The PWM stop circuit 28 is configured of a comparator and an AND circuit and outputs a high signal to Pin No. 3 (CE) of the step-up DC/DC controller IC 27 when the feedback voltage FBV is within the range between 0.2V and 1.1V and when, on the other hand, the feedback voltage FBV is below 0.2 V as the second predetermined voltage, or when the feedback voltage FBV is higher than 1.1 V as the third predetermined voltage, outputs a low signal to Pin No. 3 (CE) of the step-up DC/DC controller IC 27. Thus, when the feedback voltage FBV is within the range between 0.2V and 1.1V as the proper range for performing PWM control, a high signal is input to Pin No. 3(CE) of the step-up DC/DC controller IC 27, so that a PWM signal is output to the step-up DC/DC converter 22 and a proper stepped up voltage is supplied by the step-up DC/DC converter 22 to the LED device 12*c*. When, on the other hand, the feedback voltage FBV is below 0.2V or above 1.1V, a low signal is input to Pin No. 3(CE) of the step-up DC/DC controller IC 27 so that the outputting of the PWM signal to the step-up DC/DC converter 22 is stopped, and thus an overvoltage is prevented from being applied to each part of the step-up DC/DC converter 22 or the terminal 22*a* with which the anode side of the LED device 12*c* is connected.

(3) Variations

Although, in the above described embodiment, the LED drive circuit 20 has been provided separate from the liquid crystal module 12 including the panel drive circuit 12*b*, such a configuration may for example be made in which the voltage detector 24, PWM control circuit 26, and PWM stop circuit 28 of the LED drive circuit 20 are incorporated in the panel drive circuit 12*b*. The step-up DC/DC converter 22 may for example be mounted on the same circuit board on which the microcomputer 14 and the like are mounted and externally attached to the liquid crystal module 12.

Figure 4:
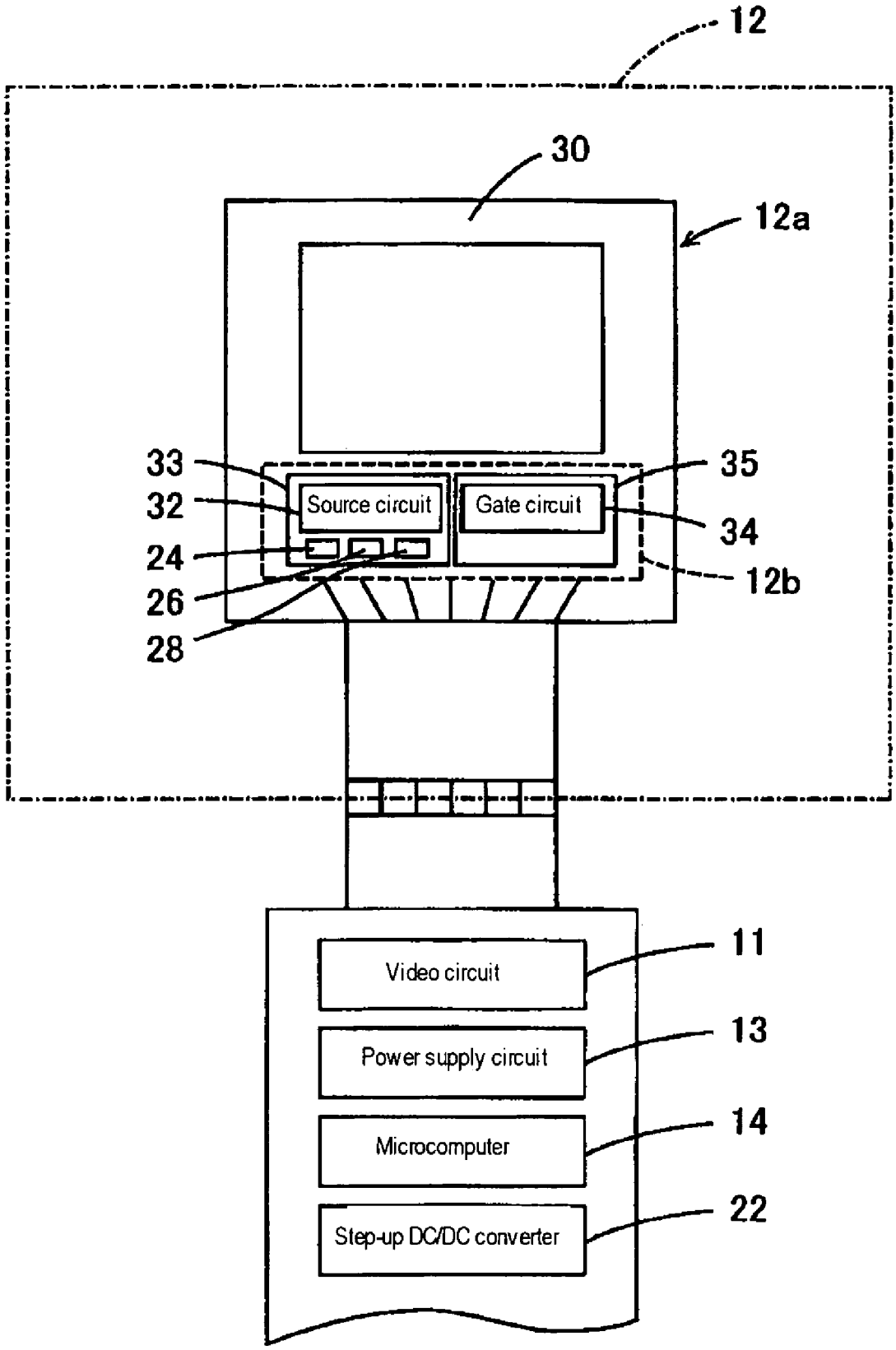
FIG. 4 is a diagram exemplifying a schematic configuration having various circuits mounted in a liquid crystal monitor apparatus.
Figure 5:
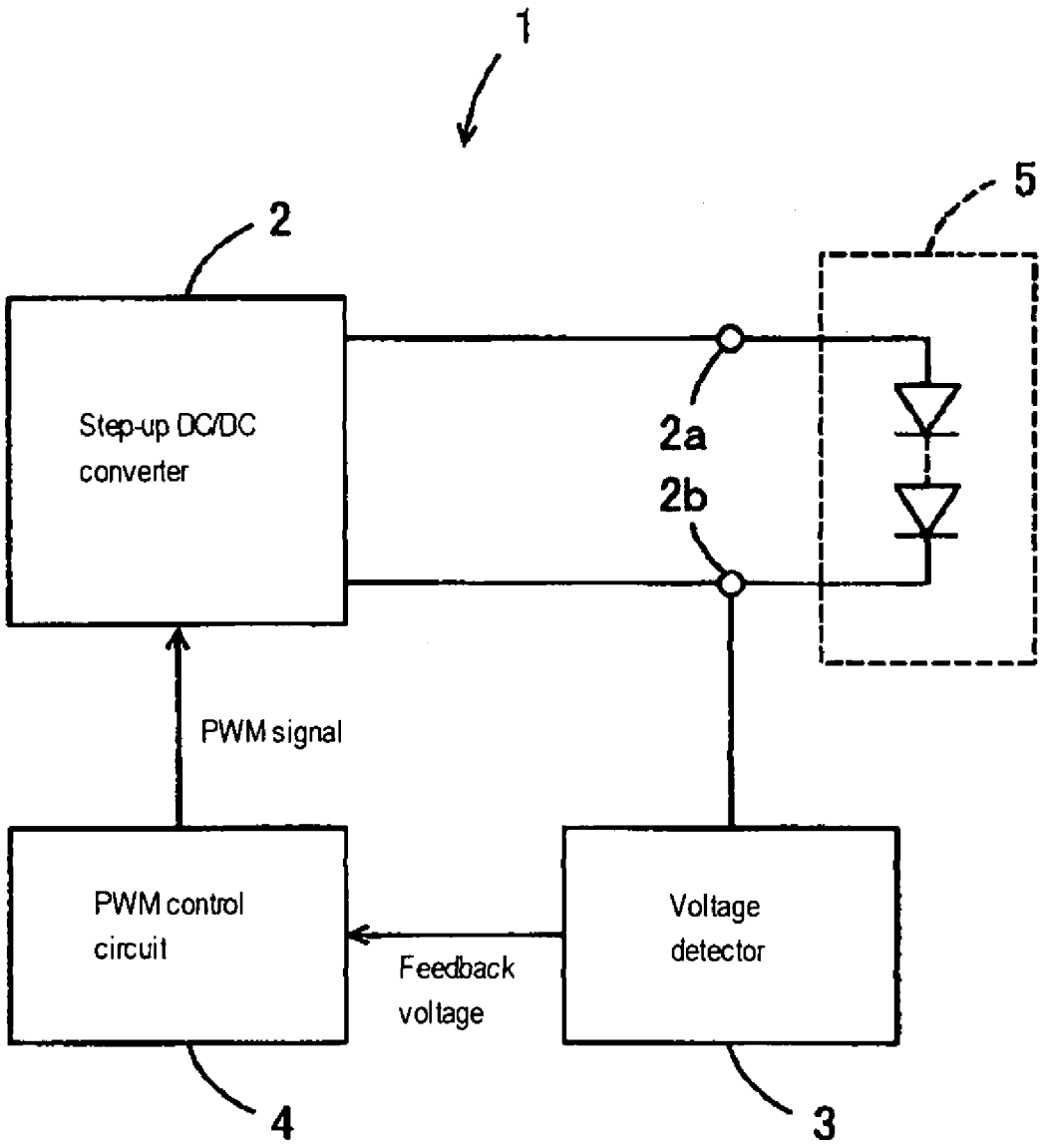
FIG. 5 is a block diagram exemplifying a conventional backlight LED drive circuit.

FIG. 4 is a schematic diagram showing a mounted state of each circuit of the liquid crystal monitor apparatus 10.

Referring to FIG. 4, one or a plurality of substrates mounting the video circuit 11, power supply circuit 13, microcomputer 14, and step-up DC/DC converter 22 thereon are connected to the liquid crystal module 12 through a flat cable or connector. On the side of the liquid crystal module 12, there are shown known circuits to form the panel drive circuit 12*b*, such as a source circuit (source driver) 32 and gate circuit (gate driver) 34, mounted on a glass substrate 30 constituting the liquid crystal panel 12*a*.

Here, the source circuit 32 and gate circuit 34 are, for example, liquid crystal driver ICs 33, 35, each thereof formed of a one-chip IC provided with terminals for wiring and are integrally secured, while being electrically connected, to the glass substrate 30, by having the wiring terminals bonded onto the glass substrate 30.

The liquid crystal driver IC 33 has the voltage detector 24, PWM control circuit 26, and PWM stop circuit 28 incorporated therein.

(4) Conclusion

According to the present embodiment, as described above, when no voltage is applied to the terminal 22*b* while the step-up DC/DC converter 22 is in operation, outputting of a PWM signal to the step-up DC/DC converter 22 is suitably stopped, so that a DC power voltage, as a raw voltage to be stepped up by the step-up DC/DC converter 22 during its operation, is not stepped up. Accordingly, application of an overvoltage to each part of the step-up DC/DC converter 22 (for example the transistor TR1 and smoothing capacitor C1) or the terminal 22*a* with which the anode side of the LED device 12*c* is connected can be suitably prevented. Thus, an LED drive circuit 20 can be provided which, even when the terminals 22*a*, 22*b* with which the LED device 12*c* is connected are rendered open during its operation, will not cause any troubles in the LED device 12*c* and the step-up DECO/DC converter 22 supplying a voltage to the LED device 12*c*.

Further, according to the present embodiment, outputting of a PWM signal to the step-up DC/DC converter 22 is suitably stopped also when the DC power voltage, as the raw voltage to be stepped up by the step-up DC/DC converter 22 during its operation, is higher than a specified voltage, and hence, the stepped up voltage cannot be lowered by PWM control. Accordingly, application of an overvoltage to each part of the step-up DC/DC converter 22 or the terminal 22*a* with which the anode side of the LED device 12*c* is connected can be prevented, and therefore, any troubles will not be caused in the LED device 12*c* and the step-up DC/DC converter 22 for supplying a voltage to the LED device 12*c*.

Further, according to the present embodiment, the PWM control circuit 26, PWM stop circuit 28, and the like are incorporated in the panel drive circuit 12*b* for driving the liquid crystal panel 12*a*, further cost down and improvement in the space efficiency can be attained.

While the present invention has been described above in detail on the basis of the accompanying drawings, the present invention may also be applied to other modes.

For example, though the voltage detector 24, PWM control circuit 26, and PWM stop circuit 28 have been incorporated, together with the source circuit (source driver) 32, in the liquid crystal driver IC 33 in the above described embodiment, the same may be incorporated, together with the gate circuit (gate driver) 34, in the liquid crystal driver IC 35.

Further, the source circuit 32 and the gate circuit 34 may be incorporated, together with the voltage detector 24, PWM control circuit 26, and PWM stop circuit 28, in a one-chip IC.

Further, though the PWM stop circuit 28 has been described in the above embodiment to stop outputting of a PWM signal to the step-up DC/DC converter 22 when the feedback voltage FBV is below the second predetermined voltage and, in addition, when the feedback voltage FBV is above the third predetermined voltage, it is enough if the PWM stop circuit 28 is configured to stop the outputting of the PWM signal to the step-up DC/DC converter 22 when at least the feedback voltage FBV is below the second predetermined voltage.

The above description being of a preferred embodiment, the invention may be carried out in various modifications and improvements based on the knowledge of persons skilled in the art.

While the invention has been particularly shown and described with respect to preferred embodiments thereof, it should be understood by those skilled in the art that the foregoing and other changes in form and detail may be made therein without departing from the spirit and scope of the invention as defined in the appended claims.

What is claimed is:

1. A backlight LED drive circuit for driving an LED device for use in a backlight of a liquid crystal panel, the backlight LED drive circuit comprising:

a step-up DC/DC converter for stepping up a DC power voltage based on a PWM signal and supplying a stepped up voltage to an anode side of the LED device;

a voltage detector for detecting a feedback voltage based on a voltage at a terminal coupled with a cathode side of the LED device;

a PWM control circuit for controlling the PWM signal output to the step-up DC/DC converter so that the feedback voltage becomes a predetermined voltage set as a feedback voltage for illuminating the LED device appropriately; and a PWM stop circuit for stopping the outputting of the PWM signal to the step-up DC/DC converter when the feedback voltage is below a second predetermined voltage set lower than the predetermined voltage, when the PWM control circuit controls the PWM signal so that the feedback voltage becomes the predetermined voltage.

2. The backlight LED drive circuit according to claim 1, wherein the second predetermined voltage is an open/closed determining voltage for determining that no voltage is applied to the terminal while the step-up DC/DC converter is in operation.

3. The backlight LED drive circuit according to claim 1, wherein the PWM stop circuit stops the outputting of the PWM signal to the step-up DC/DC converter also when the feedback voltage is above a third predetermined voltage set higher than the predetermined voltage.

4. The backlight LED drive circuit according to claim 3, wherein the third predetermined voltage is a high voltage determining voltage for determining that the DC power voltage, as a row voltage to be stepped up while the step-up DC/DC converter is in operation, is above a specified voltage.

5. The backlight LED drive circuit according to claim 1, wherein the PWM control circuit and the PWM stop circuit are incorporated in a panel drive circuit for driving the liquid crystal panel.

6. The backlight LED drive circuit according to claim 5, wherein the panel drive circuit is constituted of a liquid crystal driver IC mounted on a glass substrate configuring the liquid crystal panel.

7. The backlight LED drive circuit according to claim 1, wherein the step-up DC/DC converter is configured of a chopper type DC/DC converter having:

a choke coil connected to the DC power voltage of 3.3V, a switching element connected to the choke coil and performing a switching operation based on the PWM signal, and a smoothing capacitor connected to an output side, and wherein the PWM control circuit and the PWM stop circuit are incorporated in a liquid crystal driver IC mounted on a glass substrate configuring the liquid crystal panel to output the PWM signal to the chopper type DC/DC converter so that the feedback voltage may become the predetermined voltage set at 0.6V, and to stop the outputting of the PWM signal to the step-up DC/DC converter when the feedback voltage is below the second predetermined voltage set at 0.2V to determine that no voltage is applied to the terminal while the chopper type DC/DC converter is in operation, or when the feedback voltage is above a third predetermined voltage set at 1.1V to determine that the DC power voltage, as the raw voltage to be stepped up by the chopper type DC/DC converter during its operation, is higher than the specified voltage, 3.3V.

* * * * *